US009387916B2

(12) United States Patent
Skauen

(10) Patent No.: US 9,387,916 B2
(45) Date of Patent: Jul. 12, 2016

(54) JOYSTICK, SYSTEM AND METHOD FOR MANOUVERING A BOAT

(71) Applicant: SLEIPNER MOTOR AS, Fredrikstad (NO)

(72) Inventor: Ronny Skauen, Fredrikstad (NO)

(73) Assignee: SLEIPNER MOTOR AS, Fredrikstad (NO)

( * ) Notice: Subject to any disclaimer, the term of this patent is extended or adjusted under 35 U.S.C. 154(b) by 0 days.

(21) Appl. No.: 14/426,538

(22) PCT Filed: Sep. 5, 2013

(86) PCT No.: PCT/NO2013/050150

§ 371 (c)(1),
(2) Date: Mar. 6, 2015

(87) PCT Pub. No.: WO2014/038953

PCT Pub. Date: Mar. 13, 2014

(65) Prior Publication Data

US 2015/0246716 A1 Sep. 3, 2015

Related U.S. Application Data

(60) Provisional application No. 61/697,548, filed on Sep. 6, 2012.

(30) Foreign Application Priority Data

Sep. 6, 2012 (EP) ..... 12006297

(51) Int. Cl.
*B63H 25/02* (2006.01)
*B63H 25/42* (2006.01)
(Continued)

(52) U.S. Cl.
CPC ..... *B63H 25/02* (2013.01); *B63H 21/21* (2013.01); *B63H 21/213* (2013.01); *B63H 25/42* (2013.01); *G05G 9/047* (2013.01); *B63H 2025/026* (2013.01)

(58) Field of Classification Search
CPC ..... B63H 11/11; B63H 11/107; B63H 25/02; B63H 21/21; B63H 25/42; B63H 25/00; B63H 25/04; B63H 25/46
USPC ..... 114/144 R, 144 RE, 150, 151; 440/40
See application file for complete search history.

(56) References Cited

U.S. PATENT DOCUMENTS 4,538,035 A 8/1985 Pool
4,691,659 A * 9/1987 Ito ..... B63H 21/213 114/144 R (Continued)

FOREIGN PATENT DOCUMENTS

EP 0 363 739 A1 4/1990
EP 0 712 062 A2 5/1996

(Continued)

*Primary Examiner* — Lars A Olson
(74) *Attorney, Agent, or Firm* — Birch, Stewart, Kolasch & Birch, LLP

(57) ABSTRACT

A boat maneuvering joystick, system and method for maneuvering a boat. The joystick has a base with sensors arranged for detecting a position of the maneuvering stick. The maneuvering stick comprises a first bidirectional control knob and a second bidirectional control knob, arranged movably relative each other. The joystick comprises first control sensors detecting a first position of the first bidirectional control knob and second control sensors detecting a second position of the stern control knob. The system comprises a maneuvering control unit comprising a bow thruster output terminal and a propulsion output terminal. The maneuvering control unit is arranged for receiving position, first and second control signals and calculating a bow thruster signal and a propulsion signal. A dual mode joystick is also shown.

16 Claims, 6 Drawing Sheets

(51) Int. Cl.
*B63H 21/21* (2006.01)
*G05G 9/047* (2006.01)

(56) References Cited

U.S. PATENT DOCUMENTS 4,962,448 A 10/1990 DeMaio et al.
5,362,269 A * 11/1994 Leach ..... B63B 35/73
114/144 R
6,538,217 B1 3/2003 Eriksen et al.
2007/0113769 A1 5/2007 Stallings et al.

FOREIGN PATENT DOCUMENTS

EP 1 195 320 A2 4/2002
EP 1 353 257 A1 10/2003
EP 1 195 320 B1 11/2006
WO WO 2010/039952 A1 4/2010

* cited by examiner

JOYSTICK, SYSTEM AND METHOD FOR MANOUVERING A BOAT

CROSS REFERENCE TO RELATED APPLICATIONS

This application is the National Phase of PCT International Application No. PCT/NO2013/050150, filed on Sep. 5, 2013, which claims priority under 35 U.S.C. 119(e) to U.S. Provisional Application No. 61/697,548, filed on Sep. 6, 2012 and under 35 U.S.C. 119(a) to Patent Application No. 12006297.1, filed in Europe on Sep. 6, 2012, all of which are hereby expressly incorporated by reference into the present application.

FIELD OF THE INVENTION

The present invention relates to the field of watercraft manoeuvring, such as manoeuvring of vessels and boats. More particularly it relates to a boat manoeuvring joystick, a boat manoeuvring system and a method for manoeuvring a boat.

BACKGROUND OF THE INVENTION

Traditionally docking of watercrafts has been one of the more critical and difficult tasks to perform for a seaman. Especially when the weather conditions are harsh and the watercrafts or boats are relatively large.

A number of systems have been developed to ease docking of ships and boats.

In most cases manual docking control is required, at least for security reasons. In addition, docking is often a combination of automatic and manual docking procedures to control propulsion, thruster and possibly rudder devices. Efficient and intuitive docking control systems are therefore required. Bow and stern thrusters have for several years been used as a means for manoeuvring large and small watercraft in situations where the watercraft speed is too low to enable adequate rudder control. Particularly in connection with docking and setting off, or other low speed operations, thrusters are useful.

Bow and stern thrusters may be electrically- or hydraulically driven, and have traditionally been controlled by means of various joystick configurations mounted on the boat control panel, and operated by the person actually steering the boat.

In European patent publication EP1195320B1 a thruster control unit is shown. A boat shaped control is used to control bow and stern thrusters of the boat by pushing the control the intended way.

One of the main challenges related to manoeuvring a ship or a boat, is the complexity of operating different controls at a time for e.g. propulsion and thrust. Many seamen, especially those of leisure boats, are using their boats only occasionally, and may not be able to maintain the necessary skill level to be able to handle and understanding the meaning of multiple controls in a stressful docking situation.

Some integrated controls have been proposed for rotatable propulsion devices, where the joystick in addition to the two-dimensional fore, aft, port and starboard operations, also can be twisted left or right from a zero-position. The twist operation is then used for calculating individual direction and propulsion of the rotatable propulsion devices to make the boat pivot around its main vertical axis.

SHORT SUMMARY OF THE INVENTION

One of the problems related to the prior art described above, where the boat pivots around its main vertical axis as a response to the twist of the stick, is that the docking operation may in certain situations become cumbersome. If, for instance there is a local wind blowing, or a local current, as may be the case where there are obstacles close to the quay, the stern of the boat may drift away from the quay during docking. A twist of the boat just before landing will take the stern closer to the quay, but will also take the bow away from the quay, and several sideways and twist operations may be necessary to complete the landing.

An object of the present invention is to disclose a docking control apparatus, and a system and method for manoeuvring a watercraft that overcomes these problems.

The disclosed invention provides a docking control and a system and method for manoeuvring a boat that that may ease the docking of a boat in a number of situations. At the same time the invention provides more freedom of operation while still being intuitive to use, due to the ergonomic design resulting from its technical features.

The present invention is in an embodiment a boat manoeuvring joystick with a base, and a manoeuvring stick extending pivotally from the base, the base comprises one or more sensors arranged for detecting a position in a two dimensional plane relative a zero position of the manoeuvring stick, the manoeuvring stick comprising a first bidirectional control knob and a second bidirectional control knob, wherein the first bidirectional control knob and the second bidirectional control knob are individually operable, the joystick further comprises one or more first control sensors arranged for detecting a position of the first bidirectional control knob and one or more second control sensors arranged for detecting a position of the second bidirectional control knob.

In an embodiment the first bidirectional control knob and the second bidirectional control knob are both individually movable in left and right directions perpendicular to a forward direction of the base from an initial position, wherein the first bidirectional control knob and the second bidirectional control knob comprises means for automatic return to the initial position.

In a further embodiment the first bidirectional control knob is arranged extending from a top of the manoeuvring stick in the same direction as the forward direction of the base, and the second bidirectional control knob is arranged extending from the top of the manoeuvring stick in an opposite direction of the forward direction of the base.

It is important for the operator of the boat to interface control devices that are intuitive to use. One of the problems related to prior art, is that there are no single intuitive control devices that can be used both for docking the boat and cruising. It will be understood that a boat's behaviour with respect to the operators control should be different when in these two modes. For instance should the available forward propulsion force in docking mode be reduced to a required minimum. It should also be safety means built into the system that reduces the probability of maloperation. In the following a single control for the operation of the boat in boat docking and cruising modes is disclosed.

In an embodiment the manoeuvring stick comprises an outer shaft element and an inner shaft element telescopically arranged relative each other, wherein the manoeuvring stick is arranged to expand telescopically from a collapsed position to an extended position when the outer shaft element is lifted relative the base, and to collapse telescopically from the extended position to the collapsed position when the outer shaft element is lowered relative the base, the manoeuvring stick further comprising one or more mode sensors arranged for detecting whether the manoeuvring stick is in the collapsed position or the elongated position.

The present invention is also in an embodiment a boat manoeuvring system comprising a boat manoeuvring joystick according to any of the embodiments described above, and a manoeuvring control unit comprising at least a bow thruster output terminal arranged for being connected to a bow thruster and a propulsion output terminal arranged for being connected to a propulsion device, wherein the manoeuvring control unit is arranged for receiving position control signals from the sensors, the manoeuvring control unit further arranged for receiving first control signals from the first control sensors and second control signals from the second control sensors and calculating at least a bow thruster signal on the bow thruster output terminal and a propulsion signal on the propulsion output terminal based on the position control signals, first control signals and second control signals.

In the embodiment where the manoeuvring stick in addition comprises an outer shaft element and an inner shaft element telescopically arranged relative each other, wherein the manoeuvring stick is arranged to expand telescopically from a collapsed position to an extended position when the outer shaft element is lifted relative the base, and to collapse telescopically from the extended position to the collapsed position when the outer shaft element is lowered relative the base, the manoeuvring stick further comprising one or more mode sensors arranged for detecting whether the manoeuvring stick is in the collapsed position or the elongated position, wherein the manoeuvring control unit is further arranged for calculating a propulsion signal indicating a larger propulsion force when the mode control signals indicate that the manoeuvring stick is in the elongated position than when the mode control signals indicate that the manoeuvring stick is in the collapsed position, when the manoeuvring stick is in a position different from the zero position.

The present invention is also in an embodiment a method for manoeuvring a boat with a boat manoeuvring joystick as described above, comprising repeating the following steps one or more times;

in a first docking operation, operating the manoeuvring stick by moving it in forward, backward, port and starboard directions to position the boat close to a quay, in a second docking operation, operating the first bidirectional control knob and/or the second bidirectional control knob to position a bow or a stern of the boat closer to the quay.

DRAWINGS

The attached figures illustrate some embodiments of the claimed invention.

FIG. 1 illustrates a boat manoeuvring system (1) according to an embodiment of the invention, with the joystick (2) shown in an isometric view. The manoeuvring control unit (4) and the connection lines are illustrated in a schematic form. In addition arrows have been used to indicate the degrees of freedom the operator has for docking of the boat.

Figure 4:
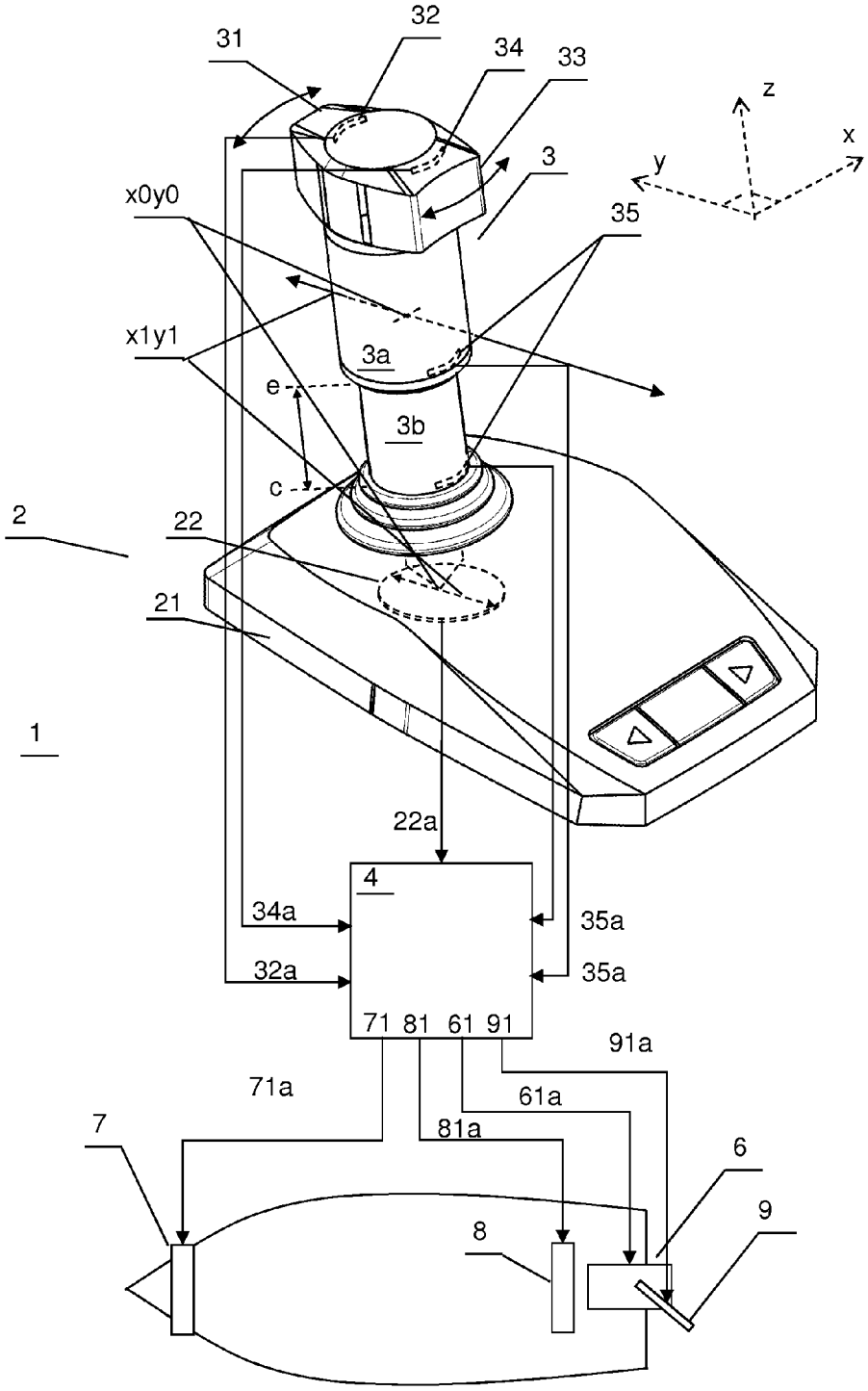

FIG. 4 illustrates a boat manoeuvring system (1) according to an embodiment of the invention, with the joystick (2) shown in an isometric view. The manoeuvring control unit (4) and the connection lines are illustrated in a schematic form. In addition arrows have been used to indicate the degrees of freedom the operator has for docking of the boat.

Figure 5A:
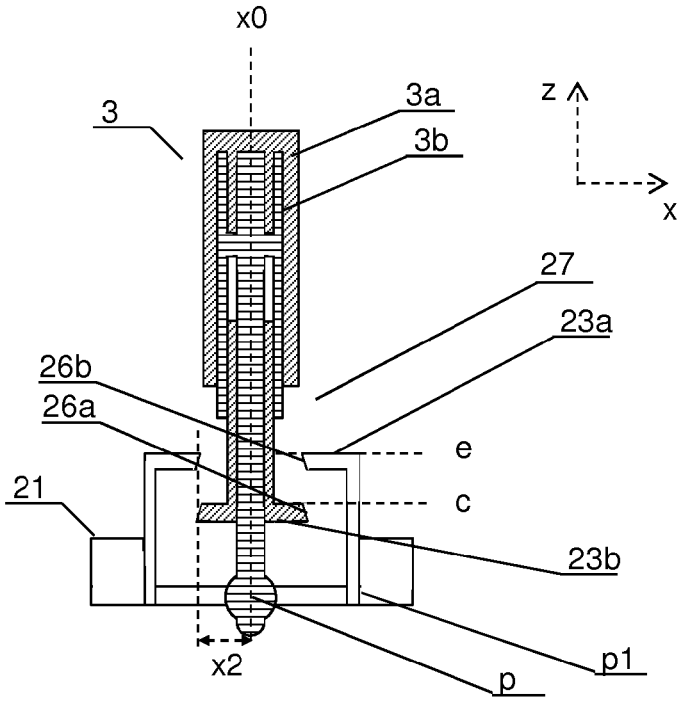

FIG. 5*a* illustrates in a front section view a joystick (2) with a telescopic mode selection according to an embodiment of the invention, a side lock (23) and an intermediate lock (25).

Figure 5B:
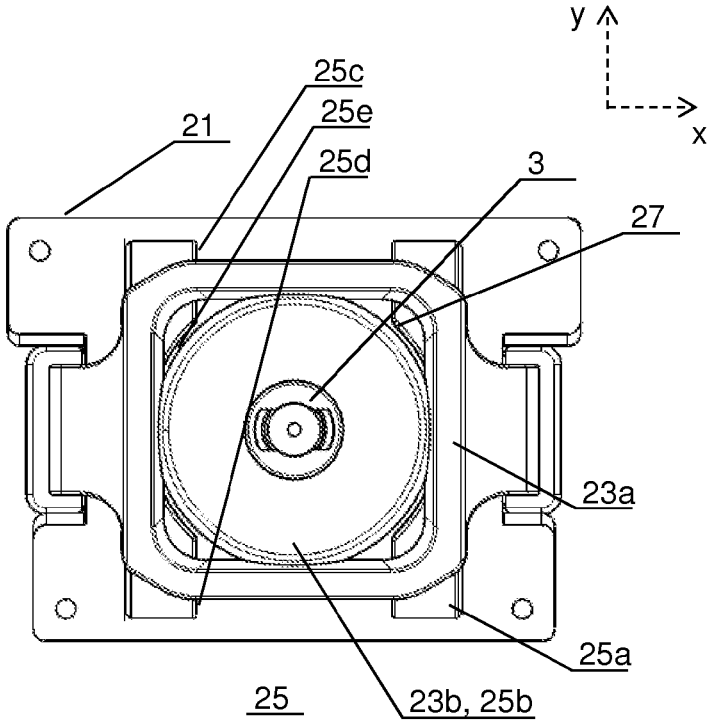

FIG. 5*b* illustrates in a top view a joystick (2) with a telescopic mode selection according to an embodiment of the invention, a side lock (23) and an intermediate lock (25).

Figure 6A:
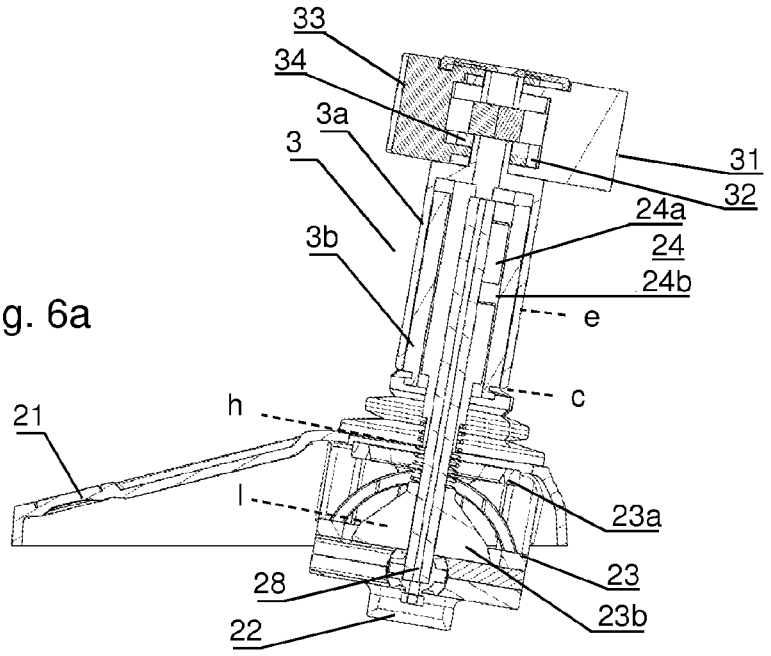
Figure 6B:
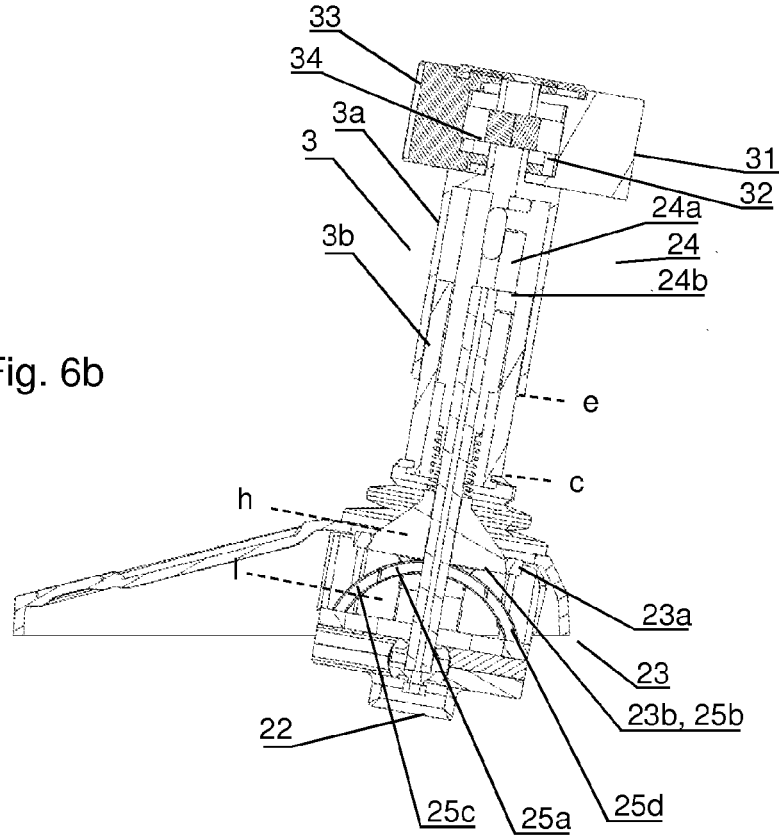

FIG. 6*a* and FIG. 6*b* illustrate in side section views a boat manoeuvring joystick (2) according to the invention, in an elongated position (e) and a collapsed position in FIGS. 6*a* and 6*b* respectively. More details are also provided in the drawings which are further explained under embodiments of the invention.

EMBODIMENTS OF THE INVENTION

With reference to the attached drawings the device and system according to the invention will now be explained in more detail.

Figure 1:
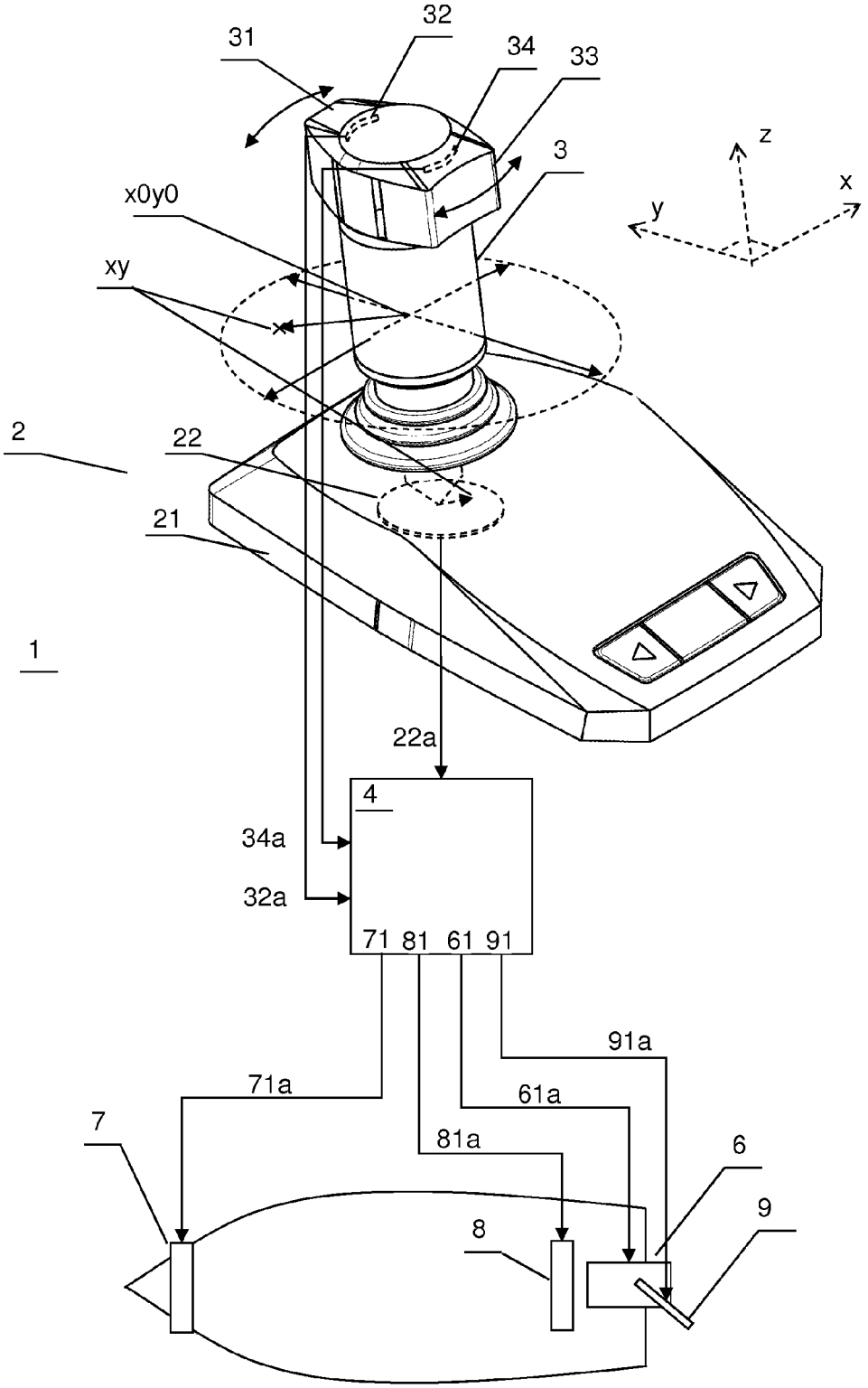

FIG. 1 illustrates in the upper part a boat manoeuvring joystick (2), according to an embodiment of the invention. In combination with the manoeuvring control unit (4) the boat manoeuvring system (1), also according to the invention, can be seen in the same figure. The lower part of the figure illustrates how the system may be connected to thrusters, propulsion devices and rudders of a boat or a vessel.

For the description of the different embodiments, the following definitions related to directions used have been defined. The boat manoeuvring joystick (2) has a forward, or fore direction defined as (y) in the drawings. This corresponds to the forward direction of the boat. The backward, or aft direction is opposite the forward direction. Lateral directions are lateral to the forward direction and in the direction of the (x) axis in the drawing. Right or starboard will be in the (x) direction and left, or port is in the opposite direction. The manoeuvring joystick (2) can operate in a spherical plane about the pivot point, however, for the purposes of this invention, the operation in a two-dimensional (xy) plane is used for simplicity. The upward direction of the manoeuvring stick (3) is denoted the (z) direction.

The boat manoeuvring joystick (2) has a base (21), and a manoeuvring stick (3) extending pivotally from the base (21). Thus the base (21) may comprise a pivotal joint that the manoeuvring stick (3) can pivot about. The pivotal point is preferably inside the base unit (21). When operated, the manoeuvring stick (3) can then move in a two dimensional or a spherical plane with constraints indicated by the stapled circle in FIG. 1.

The base (21) comprises one or more sensors (22) arranged for detecting a position (xy) in a two dimensional plane relative a zero position (x0y0) of the manoeuvring stick (3). Several solutions exist for detecting the position of a joystick in two dimensions, and any of the solutions can be used for the purpose of the invention as understood by a person skilled in the art.

The manoeuvring stick (3) comprises a first bidirectional control knob (31) and a second bidirectional control knob (33), wherein the first bidirectional control knob (31) and the second bidirectional control knob (33) are individually operable. Since the first bidirectional control knob (31) and a movable second bidirectional control knob (33) are comprised by the manoeuvring stick (3), they will follow the movements of the manoeuvring stick (3) in the two dimensional plane when the stick is operated by the operator. The first bidirectional control knob (31) and the second bidirectional control knob (33) can therefore be operated in a one-hand operation independently of the position of the manoeuvring stick (3) to give the boat additional bow and/or stern thrust when needed to pull/push the bow and/or the stern of the boat in a desired direction.

The joystick (2) further comprises one or more first control sensors (32) arranged for detecting port and starboard positions of the first bidirectional control knob (31) and one or more second control sensors (34) arranged for detecting a position of the first bidirectional control knob (31) and one or more second control sensors (34) arranged for detecting a position of the second bidirectional control knob (33). In one embodiment the first control sensors (32) and second control sensors (34) are simple switches that detect whether the controls are pushed in the port or starboard directions. In another embodiment first control sensors (32) and second control sensors (34) are value based, where the specific value of the sensor output is a function of the distance the control sensors (32) or second control sensors (34) is pushed to one side. Such sensors may be analog or digital.

In one embodiment the first bidirectional control knob (31) and the second bidirectional control knob (33) are both individually movable in left and right directions perpendicular to a forward direction of the base (21) from an initial position, wherein the first bidirectional control knob (31) and the second bidirectional control knob (33) both comprises means for automatic return to the initial position. Compared to e.g. one pushbutton for each side, a control that can slide from side to side has the advantage that the possibility of pushing the wrong button becomes much less, since a control that is pushed the same way as the intended direction of the boat is more intuitive to the operator. The automatic return to the initial position, or zero position, can be achieved by a return spring, or equivalent means depending on the type of control selected.

Figure 3:
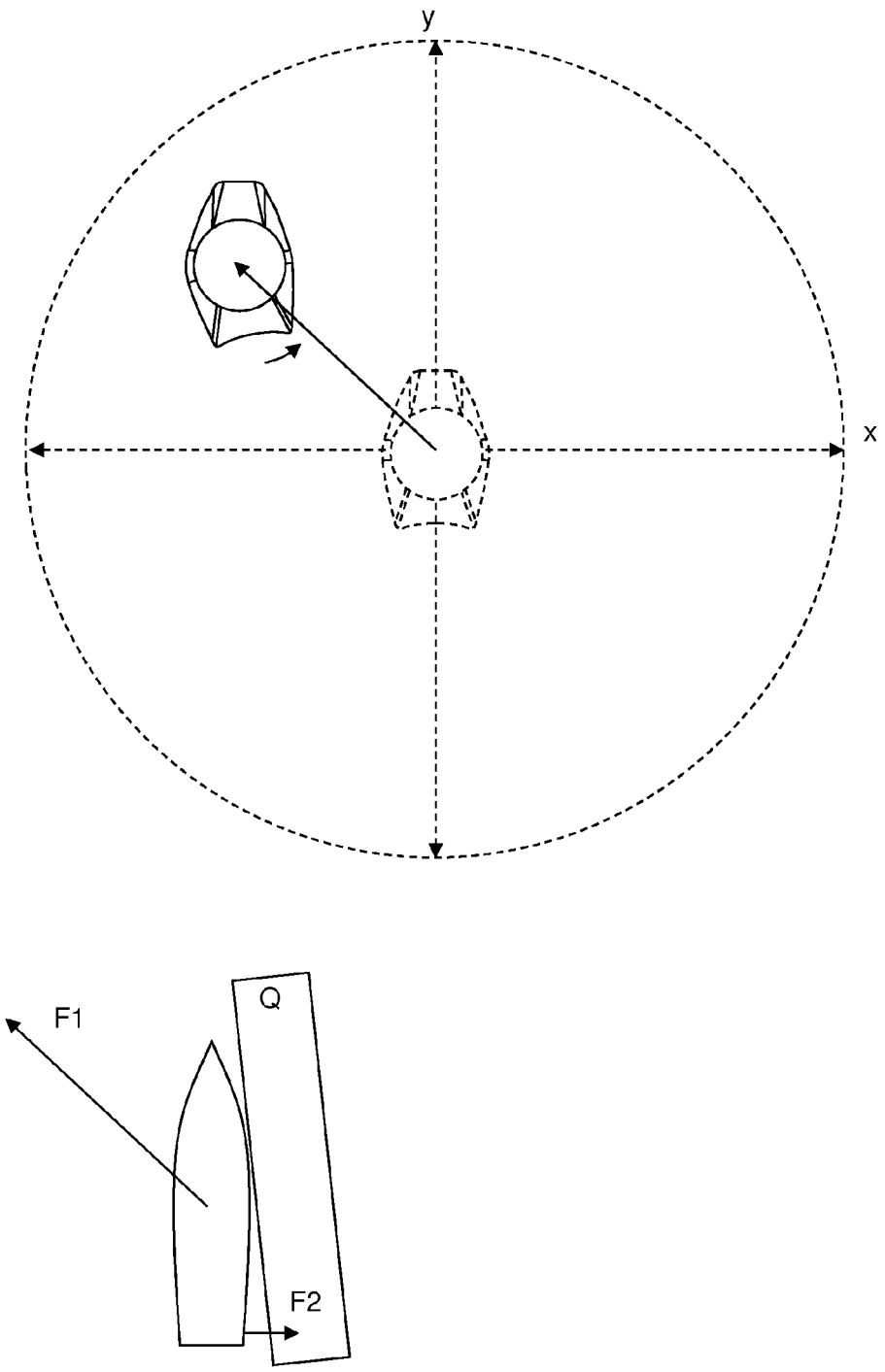
FIG. 3 illustrates more in detail how a combined one-hand joystick action according to the invention results in forces acting on the boat.

In one embodiment the first bidirectional control knob (31) is arranged extending from a top of the manoeuvring stick (3) in the same direction as the forward direction of the base (21), and the second bidirectional control knob (33) is arranged extending from the top of the manoeuvring stick (3) in an opposite direction of the forward direction of the base (21). The two control knobs (31, 33) are then located on the front and back sides of the manoeuvring stick (3) similar to what is illustrated in FIG. 3.

In an embodiment the first bidirectional control knob (31) and/or the second bidirectional control knob (33) are single axis joystick controls, and the first control sensors (32) and/or second control sensors (34) are arranged to provide first control signals (32*a*) and/or second control signals (34*a*) that are proportional with the position of the first bidirectional control knob (31) and/or the second bidirectional control knob (33).

In an embodiment the boat manoeuvring joystick (2) according to any of the embodiments described above further comprises a manoeuvring stick (3) comprising an outer shaft element (3*a*) and an inner shaft element (3*b*) telescopically arranged relative each other, wherein the manoeuvring stick (3) is arranged to expand telescopically from a collapsed position (c) to an extended position (e) when the outer shaft element (3*a*) is lifted relative the base (21), and to collapse telescopically from the extended position (e) to the collapsed position (c) when the outer shaft element (3*a*) is lowered relative the base (21), the manoeuvring stick (3) further comprising one or more mode sensors (35) arranged for detecting whether the manoeuvring stick (3) is in the collapsed position (c) or the elongated position (e).

In a further embodiment the boat manoeuvring joystick (2) comprises a side lock (23) arranged for restricting the movement of the manoeuvring stick (3) to a one dimensional movement in forward and backward directions when the manoeuvring stick (3) is in the elongated position (e), wherein the side lock (23) comprises a first side lock element (23*a*) arranged on both sides of the of the manoeuvring stick (3) at a lateral distance (x2) in a lateral direction (x) from a middle lateral position (x0), wherein the first side lock element (23*a*) is restricted from moving in the lateral direction (x) by the base (21), the side lock (23) further comprises a second side lock element (23*b*) arranged fixed in the lateral direction (x) relative the manoeuvring stick (3), wherein the side lock element (23*b*) is extending the lateral distance (x2) on both sides of the manoeuvring stick (3) in the lateral direction (x) from the middle lateral position (x0), the second side lock element (23*b*) being connected to the outer shaft element (3*a*) and arranged for being engaged with the first side lock element (23*a*) when the manoeuvring stick (3) is in the elongated position (e), and for being released from the first side lock element (23*a*) when the manoeuvring stick (3) is in the collapsed position (c).

According to an embodiment of the invention the boat manoeuvring joystick (2) as described above is comprised in a boat manoeuvring system (1). This is also illustrated in FIG. 1. In addition the boat manoeuvring system (1) comprises a manoeuvring control unit (4) comprising at least a bow thruster output terminal (71) arranged for being connected to a bow thruster (7) and a propulsion output terminal (61) arranged for being connected to a propulsion device (6), wherein the manoeuvring control unit (4) is arranged for receiving position control signals (22*a*) from the sensors (22).

The manoeuvring control unit (4) is further arranged for receiving first control signals (32*a*) from the first control sensors (32) and second control signals (34*a*) from the second control sensors (34) and calculating at least a bow thruster signal (71*a*) on the bow thruster output terminal (71) and a propulsion signal (61*a*) on the propulsion output terminal (61) based on the position control signals (22*a*), first control signals (32*a*) and second control signals (34*a*). The manoeuvring control unit (4) may be arranged in the base (21) or external to the boat manoeuvring joystick (2).

The manoeuvring control unit (4) and the connection lines are illustrated in a schematic form. In addition arrows have been used to indicate the degrees of freedom the operator has for docking the boat.

To achieve the desired independent bow trust it has been found that a bow thruster (7) is essential. In some prior art the pivoting of the boat about its main axis has been achieved by controlling direction and power of rotatable propulsion devices when twisting the joystick. It will be understood that this behaviour is very different from the behaviour achieved with a system according to the present invention where the manoeuvring control unit (4) can send control signals to the bow thruster (7) when bow thrust is required.

Since boat types exist in a huge number of shapes and configurations, the manoeuvring control unit (4) may in an embodiment of the invention be configurable to handle these specific boat types and their specific propulsion and steering devices. The requirement for a specific configuration is that the movement of the boat shall follow the movement of the manoeuvring stick (3), the first bidirectional control knob (31) and the second bidirectional control knob (33). In general the bow thruster should respond directly to the movement of the first bidirectional control knob (31).

In an embodiment the manoeuvring control unit (4) comprises a stern thruster output terminal (81) arranged for being connected to a stern thruster (8), and the manoeuvring control unit (4) is arranged for calculating a stern thruster signal (81*a*) on the stern thruster output terminal (81). The stern thruster output terminal (81) may be used where the boat has a stern thruster (8) as shown in FIG. 1, and the stern thruster could respond directly to the movement of the second bidirectional control knob (33).

A number of different propulsion devices exist, and the manoeuvring control unit (4) may be configured to control these types.

In case the boat has one or more rotatable propulsion devices, in one of the embodiments of the invention, the stern thrust could in principle be obtained by turning the propulsion devices (6) sideways, and no stern thruster (8) would be needed. In this case the manoeuvring control unit (4) is configured to control the propulsion devices (6), e.g. turning at least one of them sideways when the second bidirectional control knob (33) is pushed. Alternatively, in another embodiment of the invention, the stern thruster (8) is controlled directly by the second bidirectional control knob (33) and the propulsion devices (8) are controlled by the movement of the manoeuvring stick (3). This may give a better sideways response, since the propulsion devices do not have to be turned around before giving the desired effect. This response may be a critical issue, especially when docking the boat.

To achieve the required movement sideways of the boat, as desired when moving the manoeuvring stick (3) sideways, the manoeuvring control unit (4) may in an embodiment be configured to control the bow- and/or stern thrusters (31, 33) as a response to the sideways movement of the manoeuvring stick (3). Depending on the configuration, the additional twisting of the bow or stern thruster (31, 33) may or may not lead to additional thrust since the thrusters may already be running full speed. In addition, the manoeuvring control unit (4) may be configured to use the rotatable propulsion device(s) (6) in addition to the bow- and stern thrusters (7, 8) for the sideways movement.

In the case where the propulsion device(s) (6) are not rotatable or pivotal, a rudder (9) is most often used to make the boat turn. In this embodiment the manoeuvring control unit (4) comprises a rudder output terminal (91) arranged for being connected to a rudder (9), and the manoeuvring control unit (4) is arranged for calculating a rudder signal (91*a*) on the rudder output terminal (91). In this embodiment the manoeuvring control unit (4) will preferably be configured to use the bow- and stern thruster for direct sideways movement resulting from operating the manoeuvring stick (3), the first bidirectional control knob (31) or the second bidirectional control knob (33).

As will be understood, the present invention can be used with any combination of bow thrusters, stern thrusters, rotatable thrusters, rotatable propulsion devices, stiff propulsion devices, rudders etc. for achieving the desired operational behaviour of the boat by configuring the manoeuvring control unit (4) according to the specific configuration.

The manoeuvring control unit (4) may also interface an autopilot system that can be used for manoeuvring the boat. According to an embodiment of the invention the manoeuvring control unit (4) hands the control over to the operator as soon as the manoeuvring stick (3), the first bidirectional control knob (31) or the second bidirectional control knob (33) are operated.

Figure 2:
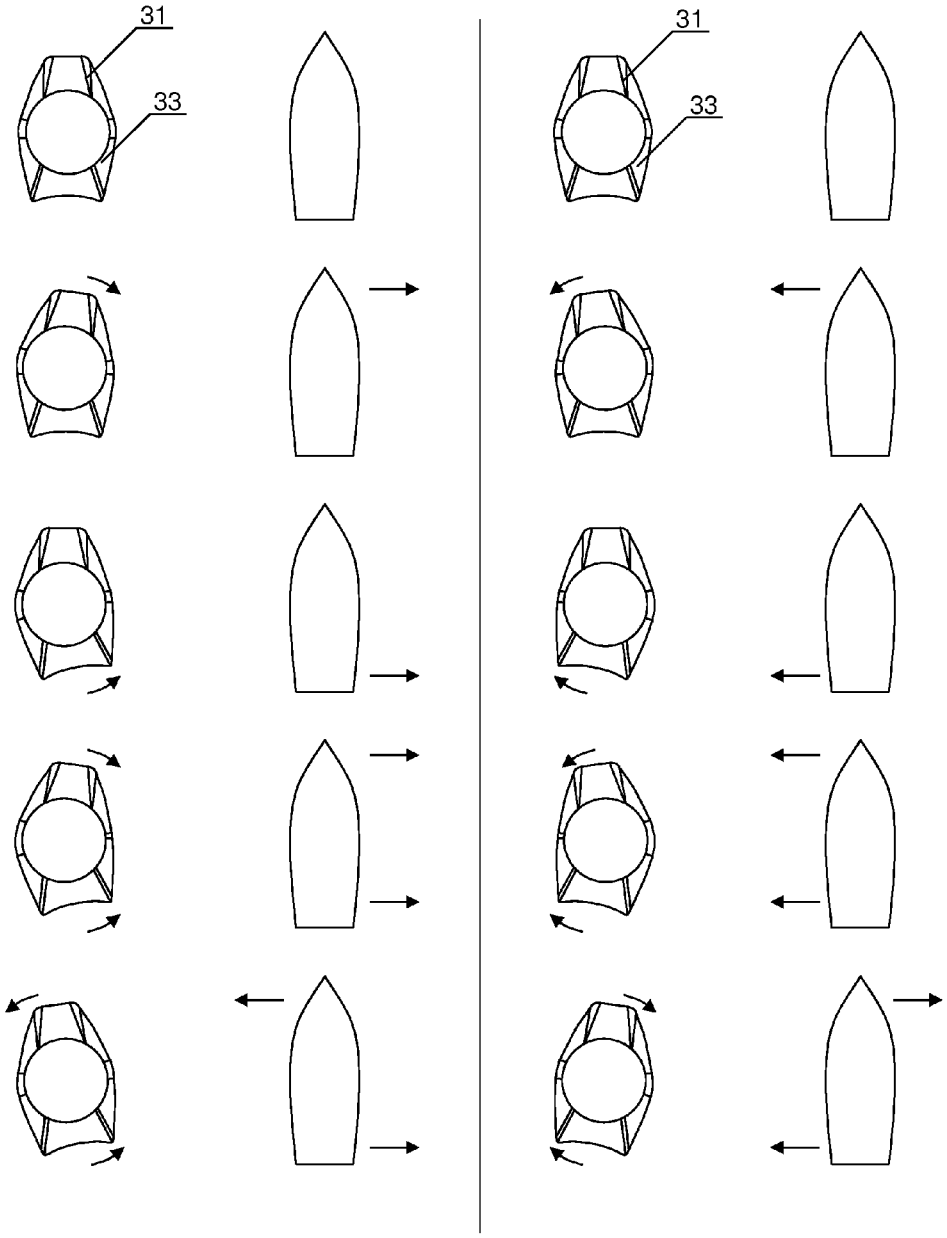
FIG. 2 illustrates forces, indicated by arrows, acting on the boat when the operator operates the first bidirectional control knob (31) and the second bidirectional control knob (33). It should be noted that the forces indicated in this figure are additional to the forces resulting from the main operation of the manoeuvring stick (3), if possible.

FIG. 2 illustrates forces, indicated by arrows, acting on the boat when the operator operates the first bidirectional control knob (31) and the second bidirectional control knob (33). It should be noted that the forces indicated in this figure are additional to the forces resulting from the main operation of the manoeuvring stick (3), if possible as described above. As will be understood from the above, the resulting forces on the boat may result from thrusters or rotatable propulsion devices depending of the configuration of the manoeuvring control unit (4). For the operator or seaman, it is important that the boat has a predictable intuitive behaviour related to movement of the joystick (2). Whether this behaviour is achieved by the use of thrusters or other devices is not important. The present invention therefore has the advantage that it can present the same expected behaviour to the users for different types of boats and boat configurations.

FIG. 3 illustrates more in detail how a combined one-hand joystick action may result in forces acting on the boat. In the upper part of the figure the dotted circle illustrates the maximum deflection of the manoeuvring stick (3) and the arrows illustrate the forward, astern, starboard and port directions respectively. In the example the manoeuvring stick (3) is moved to a position about 60 degree aport relative the forward direction of the boat, with about ⅔ of maximum deflection. Based on this information the manoeuvring control unit (4) will calculate which steering and propulsion devices to use, and their power. This will result in a steady force (F1) corresponding to the direction and deflection of the manoeuvring stick (3).

In addition, it is shown that the second bidirectional control knob (33) is pushed in the starboard direction. This will result in additional stern force (F2) acting on the stern of the boat towards starboard. It should be noted that the stern force (F2) in this case will result in the stern part of the boat be pulled in the starboard direction. This is different from control systems according to background art where the stick can be rotated, resulting in a rotational movement about the centre of the boat, i.e. the bow in this case would be pulled in the port direction. The additional flexibility of the manoeuvring system (1) according to the invention has the advantage that the docking operation can be performed more accurate. In FIG. 3 a quay, or landing stage (Q) is shown for illustration. The bow of the boat is already perfectly close to the quay, and the only remaining action is to line up the stern with the quay as well. By pushing the second bidirectional control knob (33) this can easily be achieved with the present invention. On the contrary, a rotation of the boat would certainly align it with the quay, but also remove it from the quay, and an additional right force is necessary to take it back to the quay. The advantage of the invention can be even better understood by considering that a local wind or current is acting on the stern of the boat in the port direction, and that the stern force (F2) can compensate for the drift of the stern. Local wind or current can be e.g. due to obstacles nearby that shields the bow of the boat.

According to an embodiment the boat manoeuvring system (1) in combination with any of the elements described above, comprises a manoeuvring stick (3) comprising an outer shaft element (3*a*) and an inner shaft element (3*b*) telescopically arranged relative each other, wherein the manoeuvring stick (3) is arranged to expand telescopically from a collapsed position (c) to an extended position (e) when the outer shaft element (3*a*) is lifted relative the base (21), and to collapse telescopically from the extended position (e) to the collapsed position (c) when the outer shaft element (3*a*) is lowered relative the base (21), the manoeuvring stick (3) further comprising one or more mode sensors (35) arranged for detecting whether the manoeuvring stick (3) is in the collapsed position (c) or the elongated position (e), wherein the manoeuvring control unit (4) is further arranged for receiving mode control signals (35*a*) from said mode sensors (35) for calculating a propulsion signal (61*a*) indicating a larger propulsion force when the mode control signals (35*a*) indicate that the manoeuvring stick (3) is in the elongated position (e) than when the mode control signals (35*a*) indicate that the manoeuvring stick (3) is in the collapsed position (c), when the manoeuvring stick is in a position (x1y1) different from the zero position (x0y0).

Thus, the invention is in an embodiment a method for manoeuvring a boat with a boat manoeuvring joystick (2) as described above. The method comprises repeating the following steps one or more times;

in a first docking operation, operating the manoeuvring stick (3) by moving it in forward, backward, port and starboard directions to position the boat close to a quay, in a second docking operation, operating the first bidirectional control knob (31) and/or the second bidirectional control knob (33) to position a bow or a stern of the boat closer to the quay.

It is important for the operator of the boat to interface control devices that are intuitive to use. One of the problems related to prior art, is that there are no single control devices that can be used both for docking the boat and cruising. It will be understood that a boat's behaviour with respect to the operators control should be different in the docking mode and the cruising mode. For instance should the available forward propulsion force in docking mode be reduced to a minimum. It should also be safety means built into the system that reduces the probability of maloperation.

In the following a single control for the operation of the boat in docking and cruising modes is disclosed.

The joystick (2) is also, in an embodiment a boat manoeuvring joystick (2) as shown in FIG. 4 with a base (21), and a manoeuvring stick (3) extending pivotally from the base (21), wherein the base (21) comprises one or more sensors (22) arranged for detecting a position (x1y1) relative a zero position (x0y0) of the manoeuvring stick (3), the manoeuvring stick (3) comprising an outer shaft element (3*a*) and an inner shaft element (3*b*) telescopically arranged relative each other, wherein the manoeuvring stick (3) is arranged to expand telescopically from a collapsed position (c) to an extended position (e) when the outer shaft element (3*a*) is lifted relative the base (21), and to collapse telescopically from the extended position (e) to the collapsed position (c) when the outer shaft element (3*a*) is lowered relative the base (21), the manoeuvring stick (3) further comprising one or more mode sensors (35) arranged for detecting whether the manoeuvring stick (3) is in the collapsed position (c) or the elongated position (e), wherein the boat manoeuvring joystick (2) comprising a side lock (23) arranged for restricting the movement of the manoeuvring stick (3) to a one dimensional movement in forward and backward directions when the manoeuvring stick (3) is in the elongated position (e).

The position (x1y1) of the manoeuvring stick (3) relative the base (21) indicates the operator's desired speed of the boat in a direction corresponding to the deviation and direction of the manoeuvring stick (3) in the position (x1y1). The zero position (x0y0) indicates that no thrust or propulsion is desired by the operator. One or more resilient elements can be used to keep the manoeuvring stick (3) in the zero position (x0y0) when no outer force, i.e. from the operator, is acting on the manoeuvring stick (3).

In an embodiment the sensor (22) is a magnetic sensor, sensing the position of a ferrous ball arranged at the bottom end of the manoeuvring stick (3).

The telescopic outer shaft element (3*a*) and an inner shaft element (3*b*) in an embodiment of the invention are illustrated in FIG. 4. Here it can also be seen that the manoeuvring stick (3) is currently in the extended position (e).

In an embodiment two magnetic mode sensors (35) are used, one to detect that the manoeuvring stick (3) is in the extended position (e), and one to detect that the manoeuvring stick (3) is in the collapsed position (c). In an alternative embodiment only one mode sensor is used to detect that the manoeuvring stick (3) is in the extended position (e), since it can be assumed that the manoeuvring stick (3) is in the collapsed position (e) if it is not detected that it is in the extended position (e). Two mode sensors (35) would in most cases provide a more reliable system.

According to the invention, the operator will be able to operate the manoeuvring stick (3) in sideways, forward and backward directions when in the extended position (e) and only in forward and backward directions when in the collapsed position (c). A control system connected to the mode sensors may use the position information to assign different behaviour to the boat in the two modes. This two sets of behaviours, often referred to as docking mode and cruising mode has been controlled by two different controls in prior art. The operator would then have to switch from one control to another. This is not necessary with a boat manoeuvring joystick (2) according to the invention. One of the key elements for achieving this behaviour is the side lock (23) arranged for restricting the movement of the manoeuvring stick (3) to a one dimensional movement in forward and backward directions when the manoeuvring stick (3) is in the elongated position (e).

Embodiments of the side lock (23) will now be further described with reference to FIG. 5*a* showing a section view of the boat manoeuvring joystick (2) according to an embodiment of the invention.

In an embodiment the side lock (23) comprises a first side lock element (23*a*) arranged on both sides of the of the manoeuvring stick (3) at a lateral distance (x2) in a lateral direction (x) from a middle lateral position (x0), wherein the first side lock element (23*a*) is restricted from moving in the lateral direction (x) by the base (21), the side lock (23) further comprises a second side lock element (23*b*) arranged fixed in the lateral direction (x) relative the manoeuvring stick (3), wherein the side lock element (23*b*) is extending the lateral distance (x2) on both sides of the manoeuvring stick (3) in the lateral direction (x) from the middle lateral position (x0), the second side lock element (23*b*) being connected to the outer shaft element (3*a*) and arranged for being engaged with the first side lock element (23*a*) when the manoeuvring stick (3) is in the elongated position (e), and for being released from the first side lock element (23*a*) when the manoeuvring stick (3) is in the collapsed position (c).

It can be seen from FIG. 5*a* that the manoeuvring stick (3) can be operated to the side, i.e. in the lateral direction (x) when the manoeuvring stick (3) is in the elongated position (e), but the second side lock element (23*b*) hanging on to the outer shaft element (3*a*) will follow the outer shaft element (3*a*) when this is lifted to the elongated position (e), and the second side lock element (23*b*) will be hindered by the first side lock element (23*a*) in the lateral direction (x).

In an embodiment the first side lock element (23*a*) is a plug with a first slanted surface (26*a*) and the second side lock element (23*b*) is a seat for the plug with a second slanted surface (26*b*). The slanted surfaces will then interact to limit the lift of the outer shaft element (3*a*) to the elongated position (e).

In a further embodiment the first side lock element (23*a*) is a conical plug as illustrated in FIG. 5*b*. FIG. 5*b* shows selected elements of the boat manoeuvring joystick (2) in a top view.

In an embodiment of the invention the first side lock element (23*a*) encompasses the manoeuvring stick (3) and has an opening (27) through which the manoeuvring stick (3) is extending as illustrated in FIG. 5*b*. In this embodiment the opening (27) has a size sufficiently large for allowing operation of the manoeuvring stick (3) in the lateral and forward and backward directions (x, y) when the manoeuvring stick (3) is in the collapsed position. In an embodiment the first side lock element (23*a*) is arranged to pivot in a forward and backward direction (y) about a pivot point (p1).

In an embodiment the base (21) comprises one or more springs acting on the first side lock element (23*a*) in forward and backward directions (y) arranged for keeping the first side lock element (23*a*) in the initial position (x0y0) when no force is acting on it, i.e. the operator is not pushing or dragging the manoeuvring stick (3).

In an embodiment the outer shaft element (3*a*) is arranged to rotate relative the base (21), and the manoeuvring stick (3) comprises a lift lock (24) illustrated in FIG. 6*a* and FIG. 6*b*, comprising a first lift lock element (24*a*) arranged to rotate with the outer shaft element (3*a*), and a second lift lock element (24*b*) arranged fixed relative the base (21), wherein the first lift lock element (24*a*) is arranged for being engaged with the second lift lock element (24*b*) and preventing the outer shaft element (3*a*) to be lifted when the outer shaft element (3*a*) is in a collapsed position, and further engaged for being released from the second lift lock element (24*b*) when the outer shaft element (3*a*) is rotated to allow the outer shaft element (3*a*) to be lifted from the collapsed position (c).

In an alternative embodiment the outer shaft element (3*a*) comprises one or more release buttons arranged to release the first lift lock element (24*a*) from the second lift lock element (24*b*) when operated.

In an embodiment the base (21) further comprises an elongation direction lock (25) shown in FIGS. 5*b* and 6*b*, wherein the elongation direction lock (25) comprises a bit element (25*b*) and an intermediate lock element (25*a*), wherein the bit element (25*b*) is arranged for moving from a lower position (l) when the maneuvering stick (3) is in the collapsed position (c), to a higher position (h) when the maneuvering stick (3) is in the elongated position (e), wherein the intermediate lock element (25*a*) is fixed arranged to the base (21) and comprises at least a first and a second protruding elements (25*c*, 25*d*) arranged on opposite sides of the maneuvering stick (3) and arranged for obstructing the bit element (25*b*) from moving between the lower position (l) and the higher position (h) when the maneuvering stick (3) is not in the zero position (x0y0), and further comprising an indent (25*e*) arranged for allowing the bit element (25*b*) to move from the lower position (l) to the higher position (h) only when the maneuvering stick (3) is in the zero position (x0y0).

The elongation direction lock (25) is an important security element to prevent sudden and unintended increase of the speed of the boat if the maneuvering stick (3) should be lifted when in the wrong position. Likewise, the elongation direction lock (25) will also restrain the maneuvering stick (3) from moving from the elongated position (e) to the collapsed position (c) when the maneuvering stick (3) is in not in the zero position (x0y0).

In an embodiment according to the invention illustrated in FIG. 4, the maneuvering stick (3) comprises a first bidirectional control knob (31) and a second bidirectional control knob (33), wherein the first bidirectional control knob (31) and the second bidirectional control knob (33) are arranged movably relative each other, the joystick (2) further comprises one or more first control sensors (32) arranged for detecting a first position of the first bidirectional control knob (31) and one or more second control sensors (34) arranged for detecting a second position of the second control (33) knob.

The elements of this embodiment may be combined with any of the embodiments related to the telescopic behavior and locking elements described above.

In a further embodiment related to the above embodiment, the first bidirectional control knob (31) and the second bidirectional control knob (33) are both individually movable in left and right directions perpendicular to a forward direction of the base (21) from an initial position, wherein the first bidirectional control knob (31) and the second bidirectional control knob (33) comprises means for automatic return to the initial position.

In a further embodiment related to the above embodiment, the first bidirectional control knob (31) is arranged extending from a top of the manoeuvring stick (3) in the same direction as the forward direction of the base (21), and the second bidirectional control knob (33) is arranged extending from the top of the manoeuvring stick (3) in an opposite direction of the forward direction of the base (21).

In an embodiment of the invention, the manoeuvring stick (3) comprises an inner channel for guiding wires from the first control sensors (32) and the second control sensors (34) to the base (21) as shown in FIG. 6*a*.

According to an embodiment the invention is also a manoeuvring system (1) comprising a boat manoeuvring joystick (2) according to any of the embodiments of the manoeuvring joystick (2) described above, wherein the manoeuvring system (1) in addition comprises;

a manoeuvring control unit (4) comprising at least a first thruster output terminal (71) arranged for being connected to a first thruster (7) and a propulsion output terminal (61) arranged for being connected to a propulsion device (6), wherein the manoeuvring control unit (4) is arranged for receiving mode control signals (35*a*) from the one or more mode sensors (35) and position control signals (22*a*) from the sensors (22), the manoeuvring control unit (4) further arranged for calculating a propulsion signal (61*a*) indicating a larger propulsion force when the mode control signals (35*a*) indicate that the manoeuvring stick (3) is in the elongated position (e) than when the mode control signals (35*a*) indicate that the manoeuvring stick (3) is in the collapsed position (c), when the manoeuvring stick is in a position (x1y1) different from the zero position (x0y0).

According to an embodiment the manoeuvring control unit (4) comprises a rudder output terminal (91) arranged for being connected to a rudder (9), the manoeuvring control unit (4) is arranged for receiving first control signals (32*a*) from the first control sensors (32) and second control signals (34*a*) from the second control sensors (34), and the manoeuvring control unit (4) is further arranged for calculating a rudder signal (91*a*) on the rudder output terminal (91) based on the second control signals (34*a*) from the second control (33) knob, when the mode control signals (35*a*) indicate that the manoeuvring stick (3) is in the extended position (e).

According to an embodiment the control unit (4) comprises an autopilot output terminal (101) arranged for being connected to an autopilot system (100), wherein the manoeuvring control unit (4) is arranged for calculating an autopilot direction signal (101*a*) on the autopilot output terminal (101) based on the first control signals (32*a*) from the first control (33) knob, when the mode control signals (35*a*) indicate that the manoeuvring stick (3) is in the extended position (e).

The invention claimed is:

1. A boat manoeuvring joystick comprising:

a base; and a manoeuvring stick extending pivotally from said base, wherein said base comprises one or more sensors arranged for detecting a position in a two dimensional plane relative a zero position of said manoeuvring stick, wherein said manoeuvring stick comprises a first bidirectional control knob and a second bidirectional control knob, wherein said first bidirectional control knob and said second bidirectional control knob are individually operable, wherein said joystick further comprises one or more first control sensors arranged for detecting a position of said first bidirectional control knob and one or more second control sensors arranged for detecting a position of said second bidirectional control knob, wherein said first bidirectional control knob and said second bidirectional control knob are both individually movable in left and right directions perpendicular to a forward direction of said base from an initial position, wherein said first bidirectional control knob and said second bidirectional control knob comprises means for automatic return to said initial position.

2. The boat manoeuvring joystick according to claim 1, wherein said first bidirectional control knob is arranged extending from a top of said manoeuvring stick in the same direction as said forward direction of said base, and said second bidirectional control knob is arranged extending from said top of said manoeuvring stick in an opposite direction of said forward direction of said base.

3. The boat manoeuvring joystick according to claim 2, wherein said first bidirectional control knob and/or said second bidirectional control knob are single axis joystick controls, and said first control sensors and/or second control sensors are arranged to provide first control signals and/or second control signals that are proportional with said position of said first bidirectional control knob and/or said second bidirectional control knob.

4. The boat manoeuvring joystick according to claim 1, wherein said manoeuvring stick comprises an outer shaft element and an inner shaft element telescopically arranged relative each other, wherein said manoeuvring stick is arranged to expand telescopically from a collapsed position to an extended position when said outer shaft element is lifted relative said base, and to collapse telescopically from said extended position to said collapsed position when said outer shaft element is lowered relative said base, said manoeuvring stick further comprising one or more mode sensors arranged for detecting whether said manoeuvring stick is in said collapsed position or said elongated position.

5. The boat manoeuvring joystick according to claim 4, wherein said boat manoeuvring joystick comprises a side lock arranged for restricting the movement of said manoeuvring stick to a one dimensional movement in forward and backward directions when said manoeuvring stick is in said elongated position, wherein said side lock comprises a first side lock element arranged on both sides of said manoeuvring stick at a lateral distance in a lateral direction from a middle lateral position, wherein said first side lock element is restricted from moving in said lateral direction by said base, said side lock further comprising a second side lock element arranged fixed in said lateral direction relative said manoeuvring stick, wherein said side lock element extends said lateral distance on both sides of said manoeuvring stick in said lateral direction from said middle lateral position, said second side lock element being connected to said outer shaft element and arranged for being engaged with said first side lock element when said manoeuvring stick is in said elongated position, and for being released from said first side lock element when said manoeuvring stick is in said collapsed position.

6. A boat manoeuvring system comprising:

the boat manoeuvring joystick according to claim 1; and a manoeuvring control unit comprising at least a bow thruster output terminal arranged for being connected to a bow thruster and a propulsion output terminal arranged for being connected to a propulsion device, wherein said manoeuvring control unit is arranged for receiving position control signals from said sensors, wherein said manoeuvring control unit is further arranged for receiving first control signals from said first control sensors and second control signals from said second control sensors and calculating at least a bow thruster signal on said bow thruster output terminal and a propulsion signal on said propulsion output terminal based on said position control signals, first control signals and second control signals.

7. The boat manoeuvring system according to claim 6, wherein said manoeuvring control unit comprises a stern thruster output terminal arranged for being connected to a stern thruster, and wherein said manoeuvring control unit is arranged for calculating a stern thruster signal on said stern thruster output terminal.

8. The boat manoeuvring system according to claim 6, wherein said manoeuvring stick comprises an outer shaft element and an inner shaft element telescopically arranged relative each other, wherein said manoeuvring stick is arranged to expand telescopically from a collapsed position to an extended position when said outer shaft element is lifted relative said base, and to collapse telescopically from said extended position to said collapsed position when said outer shaft element is lowered relative said base, wherein said manoeuvring stick further comprises one or more mode sensors arranged for detecting whether said manoeuvring stick is in said collapsed position or said elongated position, and wherein said manoeuvring control unit is further arranged for receiving mode control signals from said mode sensors for calculating a propulsion signal indicating a larger propulsion force when said mode control signals indicate that said manoeuvring stick is in said elongated position than when said mode control signals indicate that said manoeuvring stick is in said collapsed position, when said manoeuvring stick is in a position different from said zero position.

9. A method for manoeuvring a boat with the boat manoeuvring joystick according to claim 1, comprising repeating the following steps one or more times:

operating said manoeuvring stick in a first docking operation, by moving said manoeuvring stick in forward, backward, port and starboard directions to position said boat close to a quay; and operating said first bidirectional control knob and/or said second bidirectional control knob in a second docking operation, to position a bow or a stern of said boat closer to said quay.

10. A boat manoeuvring joystick according to claim 2, wherein said manoeuvring stick comprises an outer shaft element and an inner shaft element telescopically arranged relative each other, wherein said manoeuvring stick is arranged to expand telescopically from a collapsed position to an extended position when said outer shaft element is lifted relative said base, and to collapse telescopically from said extended position to said collapsed position when said outer shaft element is lowered relative said base, said manoeuvring stick further comprising one or more mode sensors arranged for detecting whether said manoeuvring stick is in said collapsed position or said elongated position.

11. A boat manoeuvring joystick according to claim 3, wherein said manoeuvring stick comprises an outer shaft element and an inner shaft element telescopically arranged relative each other, wherein said manoeuvring stick is arranged to expand telescopically from a collapsed position to an extended position when said outer shaft element is lifted relative said base, and to collapse telescopically from said extended position to said collapsed position when said outer shaft element is lowered relative said base, said manoeuvring stick further comprising one or more mode sensors arranged for detecting whether said manoeuvring stick is in said collapsed position or said elongated position.

12. A boat manoeuvring system comprising:

the boat manoeuvring joystick according to claim 2; and a manoeuvring control unit comprising at least a bow thruster output terminal arranged for being connected to a bow thruster and a propulsion output terminal arranged for being connected to a propulsion device, wherein said manoeuvring control unit is arranged for receiving position control signals from said sensors, wherein said manoeuvring control unit is further arranged for receiving first control signals from said first control sensors and second control signals from said second control sensors and calculating at least a bow thruster signal on said bow thruster output terminal and a propulsion signal on said propulsion output terminal based on said position control signals, first control signals and second control signals.

13. A boat manoeuvring system comprising:

the boat manoeuvring joystick according to claim 3; and a manoeuvring control unit comprising at least a bow thruster output terminal arranged for being connected to a bow thruster and a propulsion output terminal arranged for being connected to a propulsion device, wherein said manoeuvring control unit is arranged for receiving position control signals from said sensors, wherein said manoeuvring control unit is further arranged for receiving first control signals from said first control sensors and second control signals from said second control sensors and calculating at least a bow thruster signal on said bow thruster output terminal and a propulsion signal on said propulsion output terminal based on said position control signals, first control signals and second control signals.

14. The boat manoeuvring system according to claim 7, wherein said manoeuvring stick comprises an outer shaft element and an inner shaft element telescopically arranged relative each other, wherein said manoeuvring stick is arranged to expand telescopically from a collapsed position to an extended position when said outer shaft element is lifted relative said base, and to collapse telescopically from said extended position to said collapsed position when said outer shaft element is lowered relative said base, wherein said manoeuvring stick further comprises one or more mode sensors arranged for detecting whether said manoeuvring stick is in said collapsed position or said elongated position, and wherein said manoeuvring control unit is further arranged for receiving mode control signals from said mode sensors for calculating a propulsion signal indicating a larger propulsion force when said mode control signals indicate that said manoeuvring stick is in said elongated position than when said mode control signals indicate that said manoeuvring stick is in said collapsed position, when said manoeuvring stick is in a position different from said zero position.

15. A method for manoeuvring a boat with the boat manoeuvring joystick according to claim 2, comprising repeating the following steps one or more times:

operating said manoeuvring stick in a first docking operation, by moving said manoeuvring stick in forward, backward, port and starboard directions to position said boat close to a quay, and operating said first bidirectional control knob and/or said second bidirectional control knob in a second docking operation, to position a bow or a stern of said boat closer to said quay.

16. A method for manoeuvring a boat with the boat manoeuvring joystick according to claim 3, comprising repeating the following steps one or more times:

operating said manoeuvring stick in a first docking operation, by moving said manoeuvring stick in forward, backward, port and starboard directions to position said boat close to a quay, and operating said first bidirectional control knob and/or said second bidirectional control knob in a second docking operation, to position a bow or a stern of said boat closer to said quay.

* * * * *